United States Patent [19]

Collister

[11] Patent Number: 4,630,331

[45] Date of Patent: Dec. 23, 1986

[54] ONE PIECE CHILD SAFETY HANDLE

[76] Inventor: Kenneth D. Collister, 130 W. Beardsley, Elkhart, Ind. 46514

[21] Appl. No.: 747,775

[22] Filed: Jun. 24, 1985

[51] Int. Cl.[4] ..... E05B 1/02

[52] U.S. Cl. ..... 16/111 R; 16/121; 16/DIG. 12; 16/DIG. 30

[58] Field of Search ..... 16/110 R, 111 R, 118, 16/121, 124, DIG. 12, DIG. 18, DIG. 19, DIG. 24, DIG. 30; 74/553; D8/310

[56] References Cited

U.S. PATENT DOCUMENTS

| | | | |
|---|---|---|---|
| 2,849,149 | 8/1958 | Weldon | 16/121 X |
| 3,451,706 | 6/1969 | Baermann | 292/251.5 |
| 3,524,215 | 8/1970 | Kurtz | 16/124 |

OTHER PUBLICATIONS

William Hunrath Co. Inc., catalogue; New York, New York; Aug. 18, 1983.

Ace Plastic Company; Jamaica, New York; Oct. 16, 1962.

Dimco Plastic Knobs; Handbook 79, Centerville, Ohio; Sep. 5, 1980.

*Primary Examiner*—Fred Silverberg

*Attorney, Agent, or Firm*—Roger N. Coe

[57] ABSTRACT

One piece child safety handle is disclosed having a substantially circular configuration with a diameter of from about 4.25 inches to about 5 inches and having a thickness of about 0.5 inch to about 0.625 inch. The handle can be manipulated by an adult hand but not by a child's hand.

10 Claims, 4 Drawing Figures

ONE PIECE CHILD SAFETY HANDLE

FIELD OF THE INVENTION

One piece child safety handle handle means and, more particularly, to handle means for a door, drawer or the like which can be manipulated only by an adult hand.

BACKGROUND OF THE INVENTION

In homes, churches and schools in which small children are present it is essential that items which could be hazardous or injurious to the health and well being of a child be kept out of the child's reach or under lock. The typical home contains literally hundreds of medicines, poisons, solvents, corrosives, flammable materials, insecticides, alcoholic substances, knives, razors, saws and other substances and objects which must be kept away from small chidren. While the safety of the child is of paramount concern, another concern is the prevention of spills and the creation of a mess. A spilled box of detergent, a spilled bottle of syrup, an overturned container of flour or a floor full of pots and pans can cause significant temporary aggravation.

A common feature of many prior art approaches is the assumption that a toddler or child lacks the intelligence or muscular coordination required to perform certain release manipulation steps. In view of the wide variations in the natural ability of children and their ability to learn by observing the actions of adutls, such an assumption appears to be valid for only a relatively small number of children.

Children who reach the climbing age defy all attempts to place hazardous objects out of their reach. As indicated above, safety catches, unless of the lock and key type, are not always effective against the precocious child. Moreover, the more effective the safety catch the greater the inconvenience for the adult who must unlock or disconnect the safety catch each time access to a cabinet, drawer or the like is desired.

Accordingly, there is a need for means which can be operated by an adult, but not a child and which will permit ready access to a cabinet, door or container without the gyrations necessary to undo the typical safety catch. The present invention achieves the goal of a handle which is child proof, yet readily and easily useable by an adult.

SUMMARY OF THE INVENTION

An object of the present invention is to provide child proof handle means.

Yet another object of the present invention is to provide handle means for a cabinet, drawer or door which can be readily manipulated by an adult but not a child.

Still another object of the present invention is to provide inexpensive and effective handle means which is useable only by adults.

In accordance with the present invention handle means capable of use only by an adult is disclosed having a substantially circular configuration of from about 4.25 inches to about 5 inches in diameter and from about 0.5 to about 0.625 inch in thickness. The resulting handle means, resembling a large disc, is readily manipulated by an adult to overcome resistance means, such as a magnetic or spring catch, employed to retain a door or drawer in a closed position. Regardless of how advanced the child may be the child does not have sufficient strength, even using both hands, to overcome the resistance means which maintains a door or drawer in closed position. The handle means fits flush to a door or drawer and does not offer any surface on which a child can grasp.

BRIEF DESCRIPTION OF THE DRAWINGS

Other and further objects, advantages and features of the invention will be apparent to those skilled in the art from the following detailed description thereof, taken in conjunction with the accompanying drawings in which.

DESCRIPTION OF THE PREFERRED EMBODIMENTS

Figure 1:
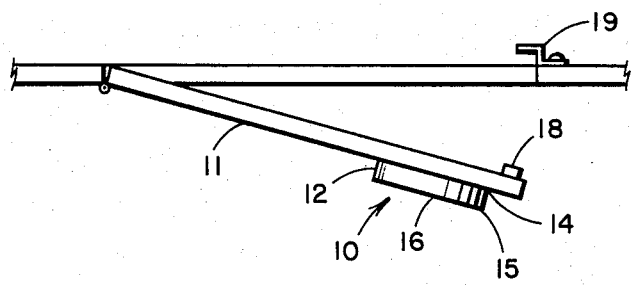
FIG. 1 is a diagrammatic top view illustrating handle means in accordance with the present invention attached to a door.
Figure 2:
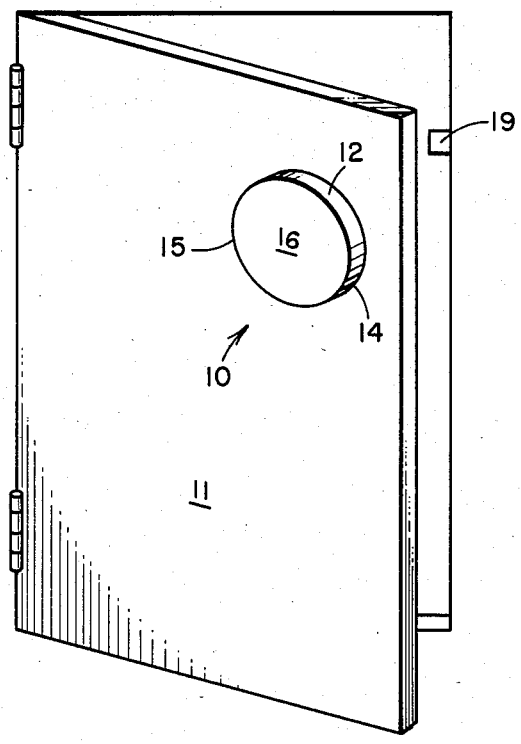
FIG. 2 is a diagrammatic perspective view of the handle means and door illustrated in FIG. 1.

Referring to the drawings, FIGS. 1 and 2 illustrate handle means in accordance with the present invention attached flush to a door. Specifically, handle means 10 in FIGS. 1 and 2 is attached flush to door 11. Handle means 10 is circular having a diameter of from about 4.25 inches to about 5 inches and a thickness of about 0.5 inch to about 0.625 inch.

Handle means 10 can be made from any suitable material including wood, plastic and metal. Preferably, the outer circumference surface 12 of handle means 10 is circular. However, circumference surface 12 can have multiple sides. If noncircular, however, circumference surface 12 should have at least eight sides and preferably at least twelve sides.

The combination of the large diameter and the thin, smooth surface 12 of handle means 10 renders it physically impossible for a nonadult to grasp handle means 10 and accordingly open door 11. Resistance means, including magnetic member 18 attached to door 11 and metal strike 19, maintains door 11 in a closed position and prevents a child from opening door 11 even when using both hands to grasp handle means 10. Thus, the present invention protects children against their own curiosity while permitting an adult, with his or her greater strength and dexterity, to easily open door 11 and gain access to the contents or area behind the door.

Figure 3:
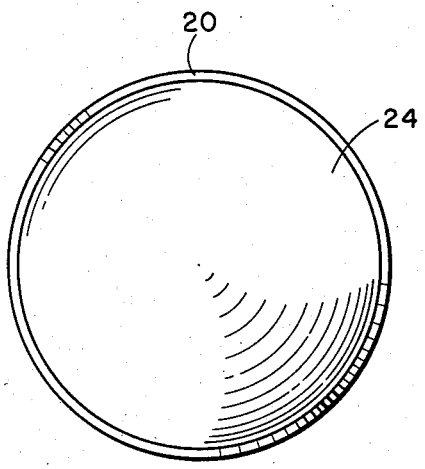
FIG. 3 is a diagrammatic front view illustrating a tapered handle in accordance with another embodiment of the invention.
Figure 4:
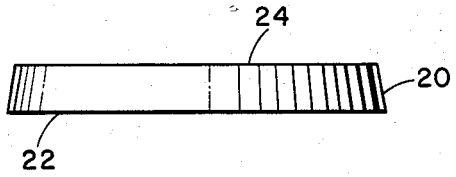
FIG. 4 is a diagrammatic side view of the handle illustrated in FIG. 3.

In another embodiment of the invention illustrated in FIGS. 3 and 4 the diameter of handle means 20 which is adjacent to a door, not shown, at edge 14 is very slightly larger in diameter than the diameter of handle means 20 at edge 24. Thus, a taper exists from edge 22 to edge 24. Such a taper does not present an insurmountable difficulty for an adult but can make it impossible for even a fairly large child to apply sufficient pressure with the fingers of his hands to obtain suffient leverage to overcome the resistance means and open a door or drawer having such handle means.

The handle means of the present invention can be readily attached to a door or drawer by almost any adult with a minimum of expense or labor using various attachment means, including glue, nails or screws. However, the means of attachment must not defeat the intended purpose and function of the invention. The mode of attachment of handle means to a door must be such that handle means is flush with the door on the side of handle means which is adjacent to the door.

The handle means of the present invention is best adapted for use on doors which are normally flush with a wall or molding such that the doors do not have any protruding surfaces which a child might use for leverage to open a door.

While the location of the handle means 10 relative to door 11 in FIGS. 1 and 2 represents a convenient and conventional location, the handle means of the present invention can be placed at any suitable location, including the center of a door.

Surface 16 of handle means 10 is shown as being plain. However, surface 16 can contain any desired pattern, e.g., a weave pattern, concentric circles, etc. and can be a concave or convex surface. If desired, surface 16 can be covered with a fabric or a material other than that forming the remainder of handle means 10.

From the foregoing, it will be seen that this invention is well adapted to attain all of the ends and objects hereinbefore set forth, together with other advantages which are obvious and inherent. The handle means can be substituted for existing door handles or knobs or can be used as original equipment. The handle means of the present invention can be used/manipulatd only by an adult and hence provides a child proof handle for doors, drawers and the like, limiting access to adults and protecting children. The handle means provides a simple, direct, positive and inexpensive solution to a very old problem - how to protect children from hazardous material and substances as well as deny children access to areas which could result in damage to valuable items or which could result in a mess if dropped or spilled. At the same time the present invention avoids the necessity for locks or catches which typically have proved inconvenient for an adult user or which render the contents of an area inaccessible even to an adult.

Obviously, many modifications and variations of the invention as hereinbefore set forth can be made without departing from the spirit and scope thereof and therefore only such limitations should be imposed as are indicated by the appended claims.

What is claimed is:

1. One piece child safety handle comprising a substantially circular disc having two substantially parallel sides, each of said sides having a diameter of between about 4.25 inches and about 5 inches and wherein the thickness of said disc between said substantially parallel sides is between about 0.5 inch and about 0.625 inch.

2. The child safety handle means of claim 1 in which the disc is made of wood.

3. The child safety handle of claim 1 in which the disc is made of plastic.

4. The child safety handle of claim 1 in which the disc is made of metal.

5. The child safety handle of claim 1 in which the diameter of one of said substantially parallel sides is larger than the diameter of the other parallel side, thereby forming a tapered edge between said substantially parallel sides.

6. The child safety handle of claim 5 in which the disc is made of wood.

7. The child safety handle of claim 5 in which the disc is made of plastic.

8. The child safety handle of claim 5 in which the disc is made of metal.

9. The child safety handle of claim 1 in which one of said substantially parallel sides is designed to fit flush against a door or drawer such that said handle can be manipulated by an adult hand and not the hand of a child.

10. The child safety handle of claim 1 in which the surface of the disc between the two substantially parallel sides is smooth.

* * * * *